US010794076B2

(12) United States Patent
May

(10) Patent No.: US 10,794,076 B2
(45) Date of Patent: Oct. 6, 2020

(54) LINEAR GUIDE RAIL SELF-TRACKING MODULAR TELESCOPING STRUCTURE

(71) Applicant: Joshua May, San Diego, CA (US)

(72) Inventor: Joshua May, San Diego, CA (US)

( * ) Notice: Subject to any disclaimer, the term of this patent is extended or adjusted under 35 U.S.C. 154(b) by 0 days.

(21) Appl. No.: 16/509,850

(22) Filed: Jul. 12, 2019

(65) Prior Publication Data

US 2019/0330870 A1 Oct. 31, 2019

Related U.S. Application Data

(63) Continuation-in-part of application No. 15/673,275, filed on Aug. 9, 2017, now Pat. No. 10,352,057, and a continuation-in-part of application No. 29/674,170, filed on Dec. 20, 2018.

(60) Provisional application No. 62/373,877, filed on Aug. 11, 2016, provisional application No. 62/729,602, filed on Sep. 11, 2018, provisional application No. 62/827,389, filed on Apr. 1, 2019.

(51) Int. Cl.
*E04H 6/04* (2006.01)

(52) U.S. Cl.
CPC ..... *E04H 6/04* (2013.01)

(58) Field of Classification Search
CPC ..... E04H 15/38; E04H 15/00
See application file for complete search history.

(56) References Cited

U.S. PATENT DOCUMENTS

| | | | | |
|---|---|---|---|---|
| 2,817,344 | A | 12/1957 | Teeter | |
| 3,030,973 | A * | 4/1962 | Janda | E04H 15/52 135/129 |
| 3,248,830 | A | 5/1966 | Maynard | |
| 3,438,158 | A | 4/1969 | Kane | |
| 3,845,591 | A | 11/1974 | Stine | |
| 4,150,682 | A | 4/1979 | Ryce | |
| 4,583,331 | A | 4/1986 | Hunt et al. | |
| 4,944,321 | A | 7/1990 | Moyet-Ortiz | |
| 4,951,993 | A | 8/1990 | Taboada | |
| 4,984,399 | A | 1/1991 | Taylor | |
| 5,013,079 | A | 5/1991 | Ho | |
| 5,044,132 | A | 9/1991 | Harman | |
| 5,740,826 | A | 4/1998 | Nevin et al. | |
| 5,746,237 | A | 5/1998 | Arnic | |
| 5,751,488 | A | 5/1998 | Wade | |
| 5,839,462 | A | 11/1998 | Randall | |
| 6,206,451 | B1 | 3/2001 | Maano | |

(Continued)

*Primary Examiner* — Noah Chandler Hawk
(74) *Attorney, Agent, or Firm* — Kirk A. Buhler; Buhler & Associates Patenting

(57) ABSTRACT

Improvements in a linear guide self-tracking modular telescoping structure is disclosed. The cover can be sized and fabricated to provide protection to a number of different uses from covering vehicles to offices, storage and operating rooms. The structure provides a fairly rigid shell to protect from objects falling on the cover and also to protect from snow loads. It uses a telescoping enclosure that retracts to occupy a small footprint when retracted. It may also include a side access door to allow a person to access the side of the structure. A power mechanism can extend and retract the cover as it is guided by the self-tracking rails. Seals not only protect from wind, snow, sand storm, extreme temperature or weather and rain, but also from rodents and insects that can accumulate within the structure if it is left unattended for a period of time.

20 Claims, 8 Drawing Sheets

(56) References Cited

U.S. PATENT DOCUMENTS

| | | | | |
|---|---|---|---|---|
| 6,430,879 | B1 * | 8/2002 | Nuiry | E04B 1/34305 4/498 |
| 6,516,822 | B2 | 2/2003 | Schlier | |
| RE42,198 | E | 3/2011 | LePage et al. | |
| 8,171,947 | B2 | 5/2012 | Hardie | |
| 8,800,581 | B1 | 8/2014 | McMaster | |
| 8,978,679 | B2 | 3/2015 | Jennings | |
| 9,765,545 | B1 | 9/2017 | Petrenko | |
| 9,777,505 | B2 | 10/2017 | Sprung | |
| 2004/0016183 | A1 | 1/2004 | Hoffman | |
| 2010/0200035 | A1 | 8/2010 | Jordache et al. | |

* cited by examiner

LINEAR GUIDE RAIL SELF-TRACKING MODULAR TELESCOPING STRUCTURE

CROSS REFERENCE TO RELATED APPLICATIONS

This application is a continuation of application Ser. No. 15/673,275 filed on Aug. 9, 2017 which claims the benefit of Provisional Application Ser. No. 62/373,877 filed Aug. 11, 2016, Provisional Application Ser. No. 62/729,602 filed Sep. 11, 2018, Design application Ser. No. 29/674,170 filed Dec. 20, 2018 and Provisional Application Ser. No. 62/827,389 filed Apr. 1, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a telescoping structure. More particularly, the present linear guide rail self-tracking modular telescoping structure creates a cover that has accordion channels. The cover can be expanded and retracted to make an enclosed structure.

Description of Related Art Including Information Disclosed Under 37 CFR 1.97 and 1.98

Many people live in houses apartment or other dwellings that do not have a garage or the person may not have room in their garage and must park a vehicle outside. There is a need for a linear guide self-tracking modular telescoping structure that can be placed in an outside area and can be quickly deployed to cover a vehicle to provide protection. A number of patents and or publications have been made to address these issues. Exemplary examples of patents and or publication that try to address this/these problem(s) are identified and discussed below.

U.S. Pat. No. 3,438,158 issued Apr. 15, 1969 to D. F. Kane discloses a Car Pod. The car pod has a flexible skin and has a front area that hinges on a rigid tubular frame to provide an opening for the vehicle. While this patent provides a covering for a parked vehicle the overall volume of the covering remains essentially the same regardless of the presence of a vehicle in the car pod.

U.S. Pat. No. 5,013,079 issued May 7, 1991 to Chao-Chuan Ho discloses a Telescopically-Operated Vehicle Canopy. The telescopically-operated vehicle canopy has a flexible covering on a plurality of tubular ribs. The ribs all pivot from a central axis to create a half-circular shell. While this provides a covering for a vehicle, the soft shell provides a high shell with additional volume above the vehicle.

U.S. Pat. No. 5,044,132 issued Sep. 3, 1991 to John T. Marman discloses a Vehicle Protective Cover Assembly. The cover assembly provides a vehicle shelter with a lifting mechanism that lifts the entire enclosure at the front of the vehicle so the vehicle can drive under the cover. The cover can then be lowered over the parked vehicle. While this patent discloses a vehicle cover, the cover has the same volume regardless of the presence of the vehicle and further requires a clearance above the vehicle to clear the open cover.

U.S. Pat. No. 6,516,822 issued on Feb. 11, 2003 to John E. Schlier discloses a Portable Canopy for use with Motor Vehicles. The vehicle canopy is a trapezoidal skin over a tubular frame and provides an opening at one end for a vehicle to enter. While this patent is a vehicle cover, the cover requires essentially the same volume regardless of the vehicle being parked under the cover or absent.

What is needed is a structure that has overlapping rigid sections that are retracted or deployed to create an enclosing structure. The proposed linear guide self-tracking modular telescoping structure provides the solution with cover that can be placed in an area and can be quickly deployed to create an enclosing structure to provide protection.

BRIEF SUMMARY OF THE INVENTION

It is an object of the linear guide self-tracking modular telescoping structure that provides protection to a vehicle. The structure can be sized and fabricated to provide protection to a number of different vehicles including cars, trucks, boats, ATV's, motorcycles, bicycles etc. The enclosure can be fabricated to accommodate generic sized vehicles and can also be sized for a specific vehicle. This allows for standard or custom enclosures depending upon the need of the vehicle owner. The structure can be used for temporary deployable structure for camping, hunting and military use. Temporary structures for oil, gas and mining operations, fabrication areas, on-site workshops, bulk material storage, unlimited military applications and humanitarian uses worldwide including quickly deployed "mash" units (mobile army surgical hospital).

It is an object of the linear guide self-tracking modular telescoping structure to provide a fairly rigid shell to protect from objects falling on the structure and also to protect from snow loads. While the enclosure is intended to protect a vehicle that is placed in an outside area, it can also be installed in a garage to provide protection from dust or from people rubbing against the enclosed vehicle.

It is another object of the linear guide self-tracking modular telescoping structure to be telescoping to extend or retract. The telescoping enclosure allows the enclosure to retract and occupy a small footprint when the structure is not being used. The telescoping shell components individually retract, telescope or accordion into each other. It is contemplated that there can be four sections, but as few as two, to more than four sections can be used depending upon the length of the stored object and the amount of space remaining after the enclosure retracts.

It is another object of the linear guide self-tracking modular telescoping structure to have an access door to allow a person to access the driver and or passenger door when the enclosure covers the vehicle. Often a vehicle owner may need something in the vehicle, and rather than retract the structure to gain access to the interior of the vehicle, an access door in one or more panels can be opened to allow access to the door of a vehicle.

It is another object of the linear guide self-tracking modular telescoping structure to be powered to retract and extend. The power mechanism can be similar to a garage door opener where a wireless or wired remote control is used. This allows a driver to open the vehicle cover as they approach, drive the vehicle into the enclosure and then press the remote button to have the vehicle enclosed and protected.

It is another object of the linear guide self-tracking modular telescoping structure to utilize a rail system that has a female pocket with a male wheel that tracks and guides the panel sections as they extend and contract. The female and male tracking guides move the panels in a straight line. Wheels on the bottom of the rails also provide a straight path for the panels to track.

It is still another object of the linear guide self-tracking modular telescoping structure, to have seals to provide protection from the elements. The seal not only protect from wind and rain, but also from rodents and insects that can accumulate in a vehicle if it is left unattended for a continued period of time.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
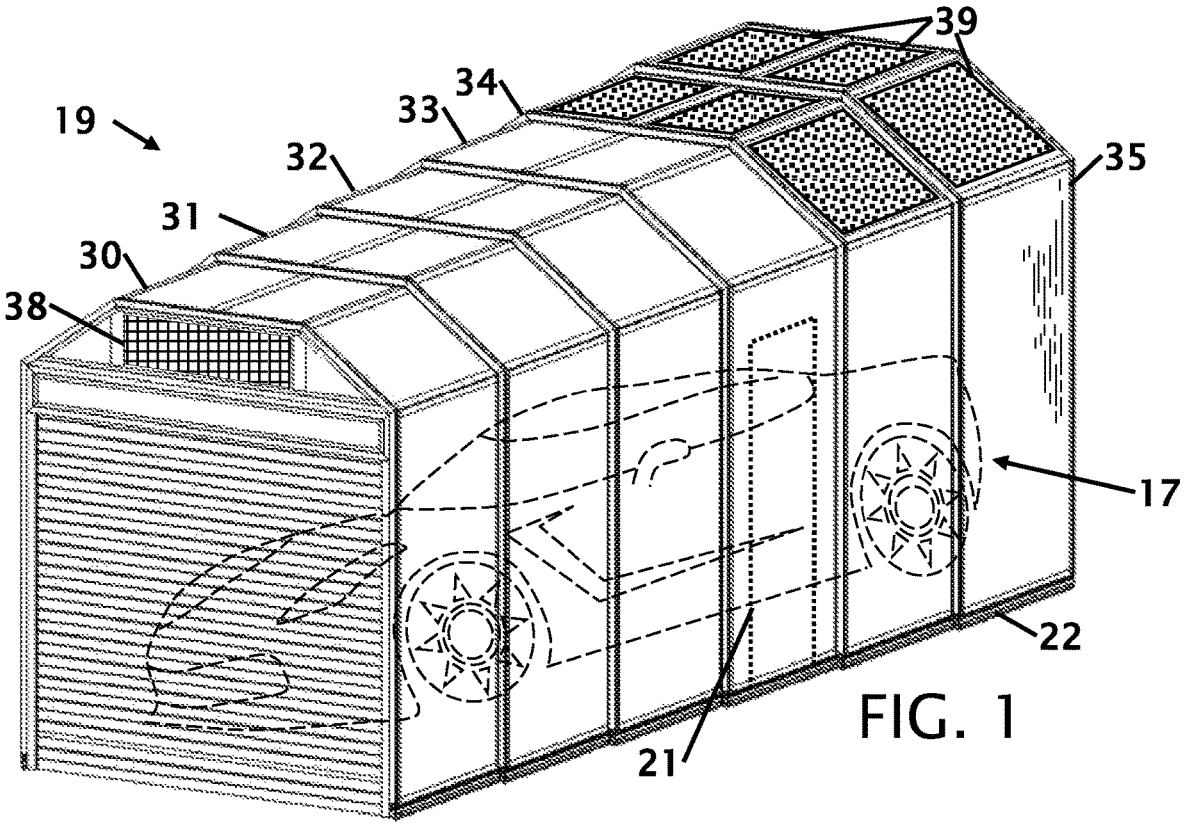
FIG. 1 shows a perspective view of the linear guide self-tracking modular telescoping structure in an extended orientation with a vehicle enclosed in the structure.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

15 vertical
16 horizontal
17 vehicle
18 retracted orientation
19 channeled retractable vehicle cover
21 door
22 wheel or caster
23 vertical movement
24 outer shaft
25 end rollers
26 spring
27 inner shaft
30-34 plurality of panels or sections
35 static base housing
38 heater or air-conditioning system
39 solar panel
48 fastener
49 angle panel
50 side panel
51 top panel
60 hold-down system
61 base plate
62 key hole
63 key
64 shaft
65 plate
66 handle
77 securing hole(s)
70 rotate
71 down
80 motor
81 transmission gears
82 suspension
83 spring(s)
91 sides
92 spool
93 door
94R, 94L sides
95 metal base section
96 bottom seal
97 motor
98 transmission
100 rail sub assembly
102 rail top extrusion
103 front rectangular "F" extrusion
104 back rectangular "F" extrusion
105 housing unit sub-frame extrusion
106 housing exterior roof frame extrusion
107 housing exterior vertical frame extrusion
108 "H" extrusion
109 angled "H" extrusion
110 counter flash angle cap extrusion
111 counter flash vertical extrusion
112 corner connector
113 wheel
114 wheel shaft
115 wheel moon clip

Figure 2:
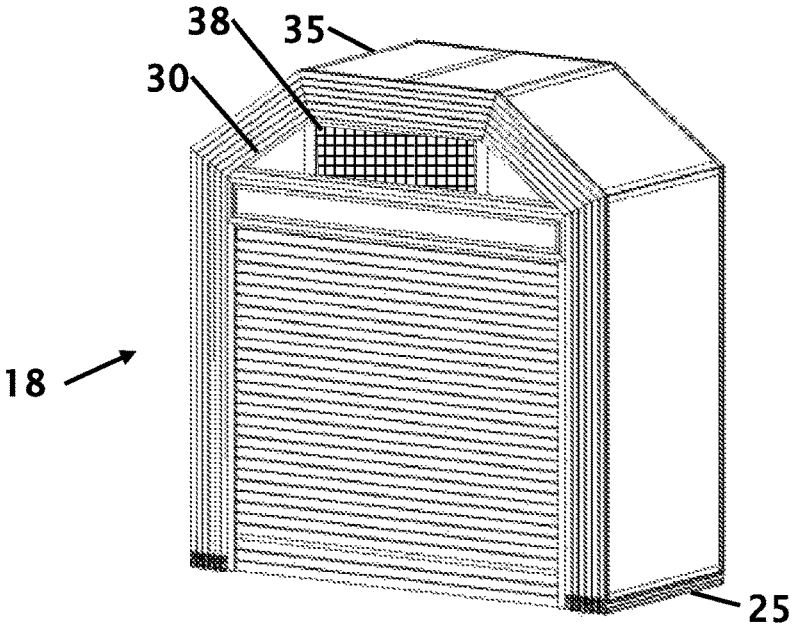
FIG. 2 shows a perspective view of the linear guide self-tracking modular telescoping structure in a retracted orientation.

116 rail guide rod and wheel
117 corner connector quick connect
118 corner connector stiffener plate
119 corner square stiffener plate first shim bracket
120 corner square stiffener plate second shim bracket
121 "H" extrusion stiffener bracket
122 corner connector stiffener bracket
123 rail guide rod and wheel seal
124 rail guide rod and wheel seal
125 "F" extrusion seal
126 female pocket
127 female pocket edges
128 wheel edges
130 brush pocket FIG. 1 shows a perspective view of the linear guide self-tracking modular telescoping structure in an extended orientation with a vehicle enclosed in the structure and FIG. 2 shows a perspective view of the linear guide self-tracking modular telescoping structure 19 in a retracted 18 orientation. The extended orientation provides protection to the entire vehicle 17 from the elements and creates a temporary garage structure around the vehicle 17. There is a static base housing 35 that is stationary and can be mounted or secured to the ground or hard surface on one end with a movable door section 30 at the other end. While a particular static and moving end(s) have been identified either side can be static or movable. It is also contemplated that the static section can be a middle section and the structure opens from the center section. A plurality of panels 31, 32, 33 and 34 extend and retract from the base housing 35. The height of the enclosure can be a standard height for generic vehicles or can be sized to a particular vehicle height and width. The last or smallest panel 30 must be sized to clear the roof of the vehicle 17 without making contact or rubbing on the top of the vehicle 17, with additional clearance considerations for the weight of the panels and any snow load that may be present on the panels. The enclosure may include a heater and or air conditioner 38 cooling system.

The moving panels 30, 31, 32, 33 and 34 have wheels 22 that allow the panels to roll along the ground. It is also contemplated that the wheels can roll in a track or guide. The embodiment in FIG. 1 shows an optional access door 21. The access door 21 to allows a person to access the driver and or passenger door when the enclosure 19 covers the vehicle 17. Often a vehicle owner may need something in the vehicle, and rather than retract the cover 19 to gain access to the interior of the vehicle 17, an access door 21 in one or more panels can be opened to allow access to the door of the vehicle 17. In one contemplated embodiment, the end rollers 25 are powered, by a powered electrically actuated wheel where the wheels are driven to move not only the section that is powered, but closes and opens all the abutted sections. The fixed base housing 35 can have a solar panel 39 that can charge batteries to allow the cover 19 to be self-contained and operate without an external power supply. The cover can also include a security system with a phone application interface for solar, security, control of opening etc., card entry system, monitoring and alarm.

The retractable vehicle cover, 19 can be completely or partially opened to allow the vehicle 17 to enter the cover. The retractable vehicle cover, 19 needs to be sufficiently retracted to allow the door(s) of the vehicle 17 to open without contacting the sides of the retractable vehicle cover 19 section(s).

In the embodiment shown, one static 33 and three moving panels 30, 31 and 32 are shown, but as few as one static section and one moving panel section is contemplated as well as one static panel or many moving panels or necessary to create an extremely compact design are contemplated. The panels can be manually pulled apart and pushed into a retracted orientation. In the preferred embodiment the entire cover is manufactured to be mailed or shipped in a semi-disassembled nearly flat manner on one or more pallets. The components can then the assembled or "snapped" together with minimal tools to assemble the enclosure. The modular assembly allows for the height, length and width of the enclosure to be adjustable to accommodate the vehicle(s) or structure specifications.

Figure 3:
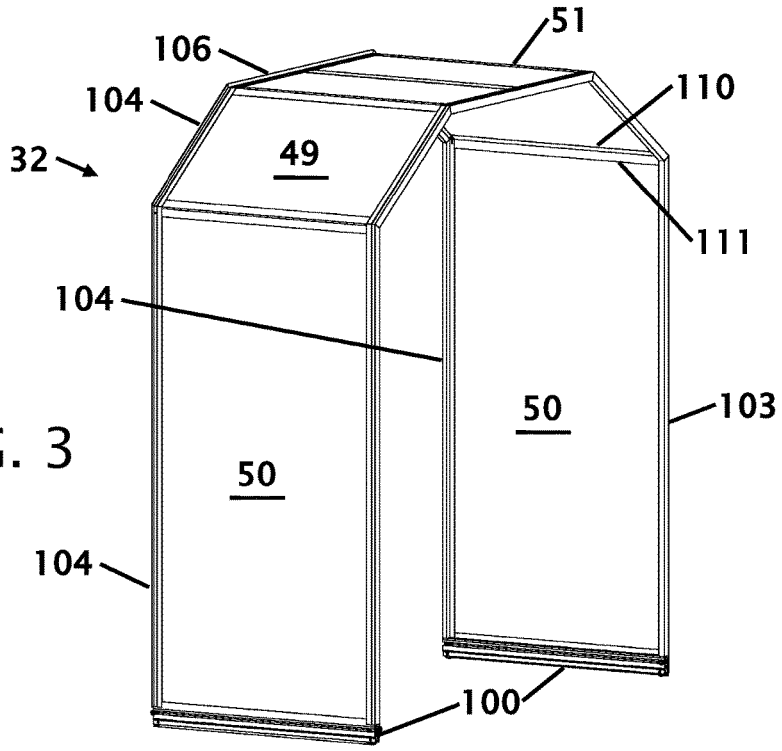
FIG. 3 shows a perspective view of a central panel section.

FIG. 3 shows a perspective view of a central panel section 32. None- or multiple central panel sections can be used based upon the structure envelope. This central panel section 32 is supported on rail 100 that will be shown and described in other figures herein. Side panels 50 and secured to each rail 100 and are supported on a first vertical side with front rectangular F extrusion 103 and on the second vertical side with back rectangular "F" extrusion 104. The top of the side panels 50 connect through a counter flash vertical extrusion 111 and a counter flash angle cap extrusion 110 that will be shown in more detail in other figures herein. An angle panel 49 connects to the counter flash angle cap extrusion 110 to another set of counter flash vertical extrusion 111 and a counter flash angle cap extrusion 110 that connects to the top panel 51. The two top panels 51 join at the center top of the central section 32 with an H extrusion 108 that is shown and described in the next figure. While the side, roof and angle sheets are shown as having a single thickness it should be understood that the side, roof and angle sheets can be formed with multiple layers for two or more of solar collectors, UV protection, transparency, weather protection, insulation and cosmetic appearance.

Figure 4:
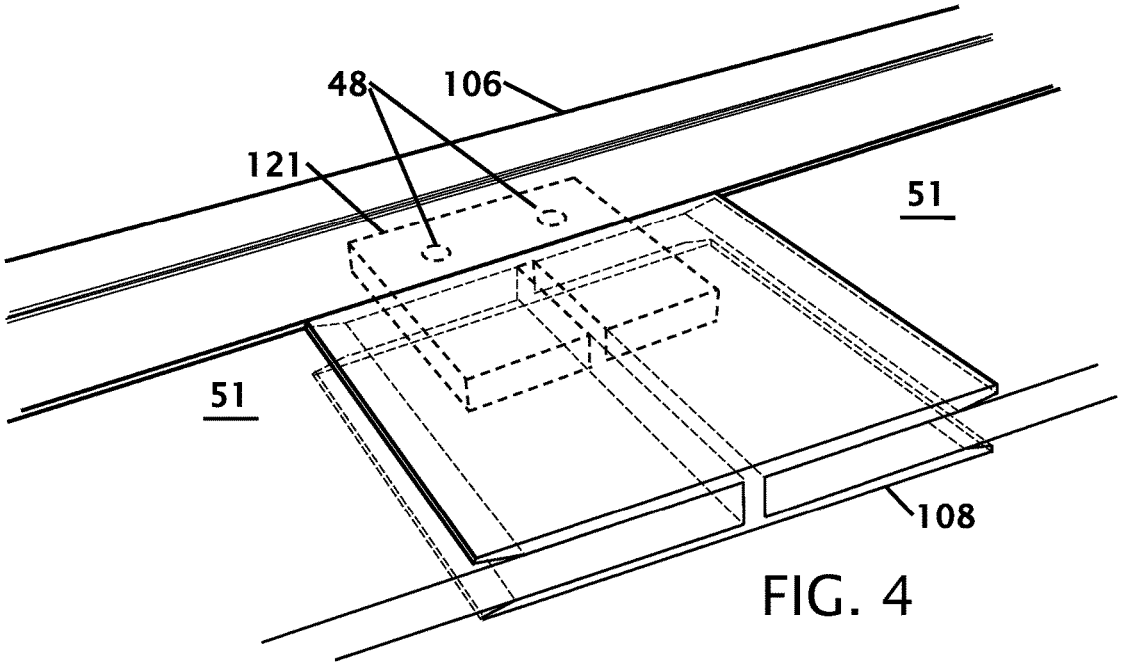
FIG. 4 shows a perspective view of a center roof joint.

FIG. 4 shows a perspective view of a center roof joint. Constructing the roof with a central "H" extrusion 108 allows for the enclosure to be easily adjusted for the width of the top. The roof top panels 51 engage into the open sections of the "H" extrusion. An "H" extrusion stiffening bracket 121 connected from the exterior roof frame extrusion 106 where it is secured with fasteners 48 or the like. Each roof top panel 51 is sealed within the housing exterior roof frame extrusion 106 and the central "H" extrusion 108.

Figure 5:
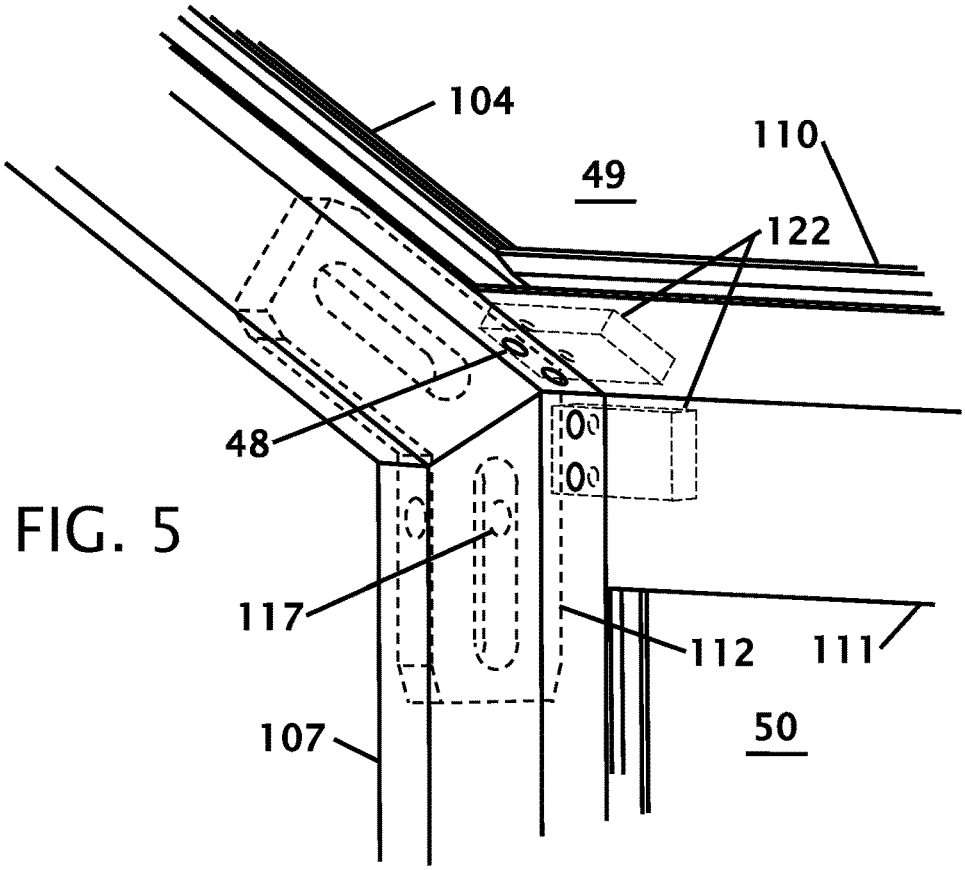
FIG. 5 shows a perspective view of the end fixed section.

FIG. 5 shows a perspective view of the end fixed section. A corner connector 112 joins the back rectangular F extrusion 104 to the housing exterior vertical frame extrusion 107. The corner connector 112 has corner connector quick connect 117 that is a spring-loaded pin that snaps and locks the parts together. A first corner connector stiffener bracket 122 joins the counter flash angle cap extrusion 110 to the back rectangular F extrusion 104 while a second corner connector stiffener bracket 122 joins the counter flash vertical extrusion 111 to the housing exterior frame vertical extrusion 107. The angle panel 49 is secured within the back rectangular "F" extrusion(s) 104 and the counter flash angle cap extrusion 110. The side panel 50 is secured within the counter flash vertical extrusion 111 and the housing exterior frame vertical extrusion 107.

Figure 6:
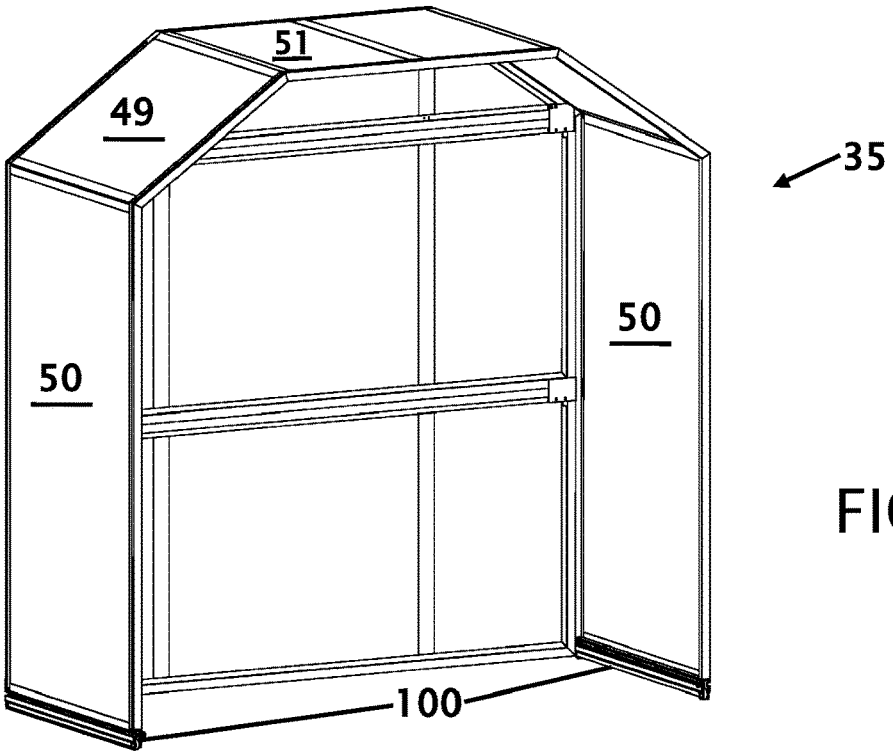
FIG. 6 shows a perspective interior view of the fixed closed section.

FIG. 6 shows a perspective interior view of the fixed closed section 35. Because this is an enclosed end there are additional structural elements that retain the angle panels 49, the side panels 50 and the top panels 51. Detailed views and description of the additional structural elements are found in later figures herein.

Figure 7:
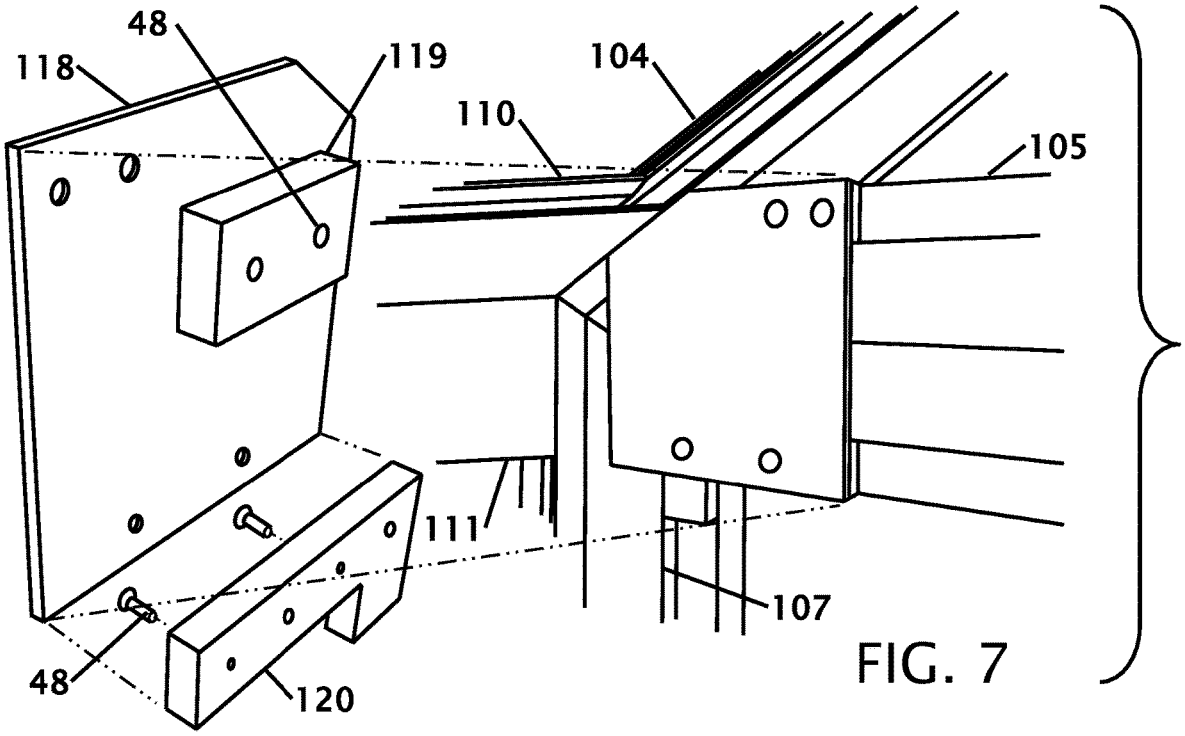
FIG. 7 shows a perspective view of a reinforced back corner joint.

FIG. 7 shows a perspective view of a reinforced back corner joint. The corner can have additional requirements for reinforcement to resist the forces caused by wind and snow loads. To combat these loads a corner connector stiffener plate 118 is used with a corner square stiffener plate first shim bracket 119 and a corner square stiffener plate second shim bracket 120, these pieces are secured with fasteners 48 or the like. The corner connector stiffener plate 118 is secured to a housing unit sub-frame extrusion 105. This figure also shows the corner extrusions of the back rectangular "F" extrusion 104, housing exterior vertical frame extrusion 107, counter flash angle cap extrusion 110 and counter flash vertical extrusion 111.

Figure 8:
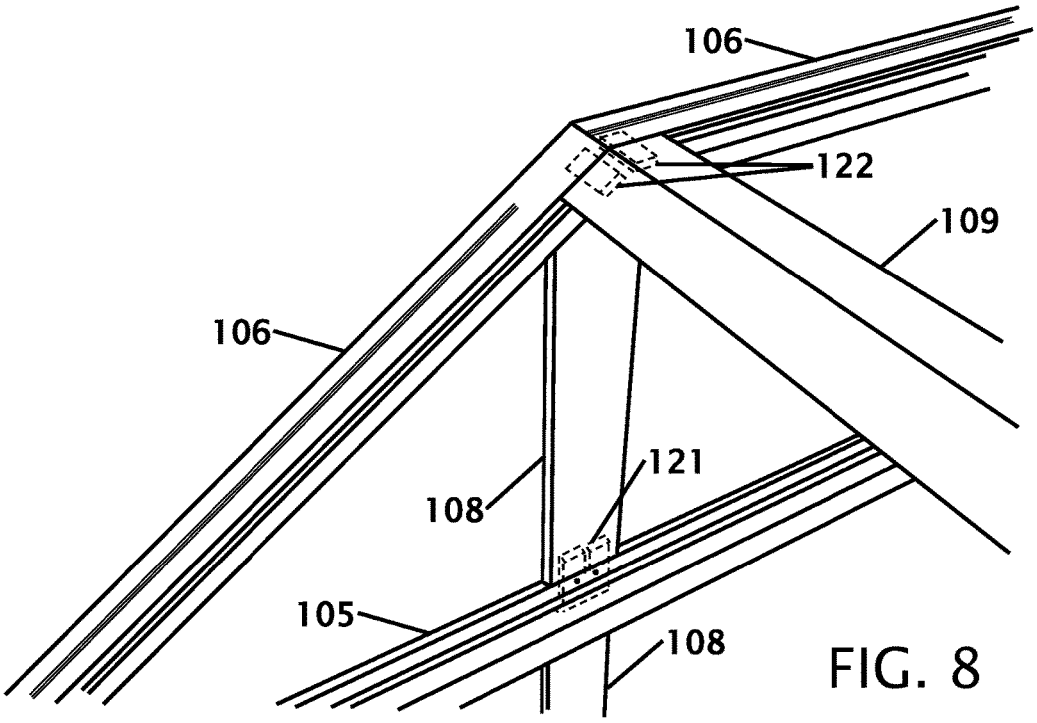
FIG. 8 shows a perspective view of a frame corner connection.

FIG. 8 shows a perspective view of a frame corner connection. In this figure the corner connector stiffener bracket 122 connects the housing exterior roof frame extrusion 106 to an angled "H" extrusion 109. H extrusion stiffener bracket 121 connects the housing unit sub-frame extrusion 105 to the H extrusion 108.

Figure 9:
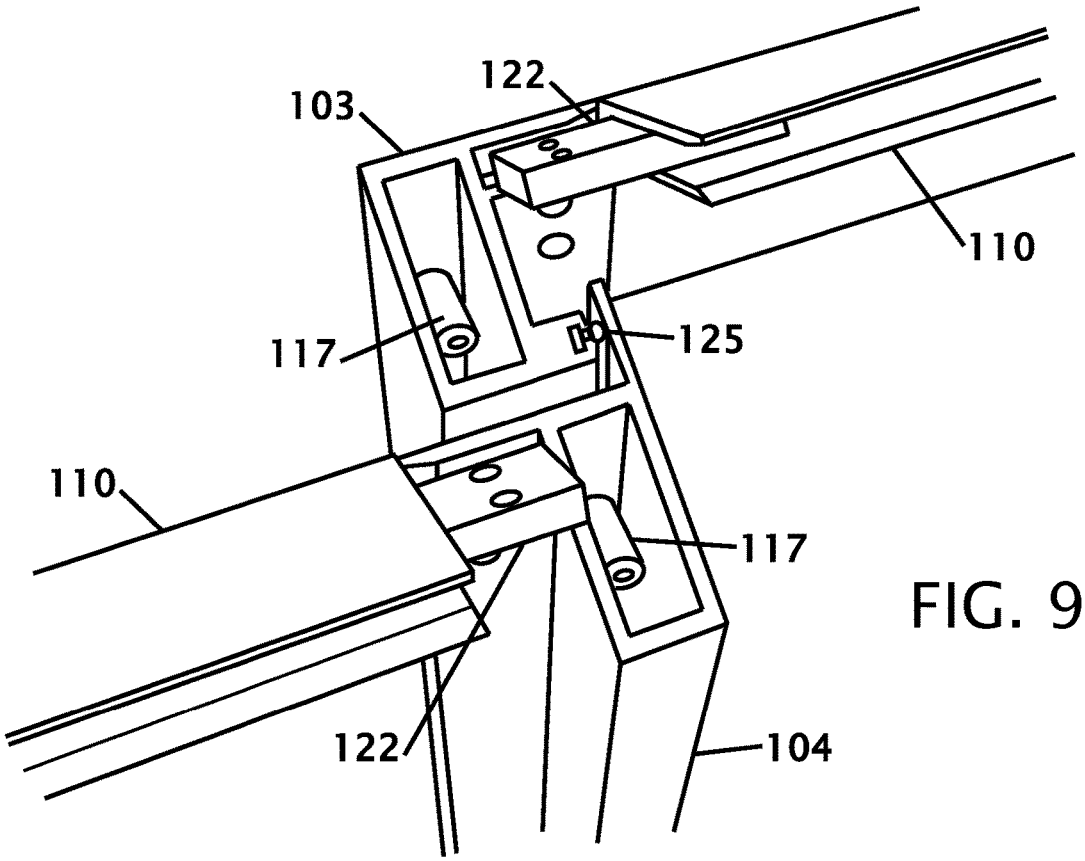
FIG. 9 shows a perspective view of an intersection between two sections.
Figure 10:
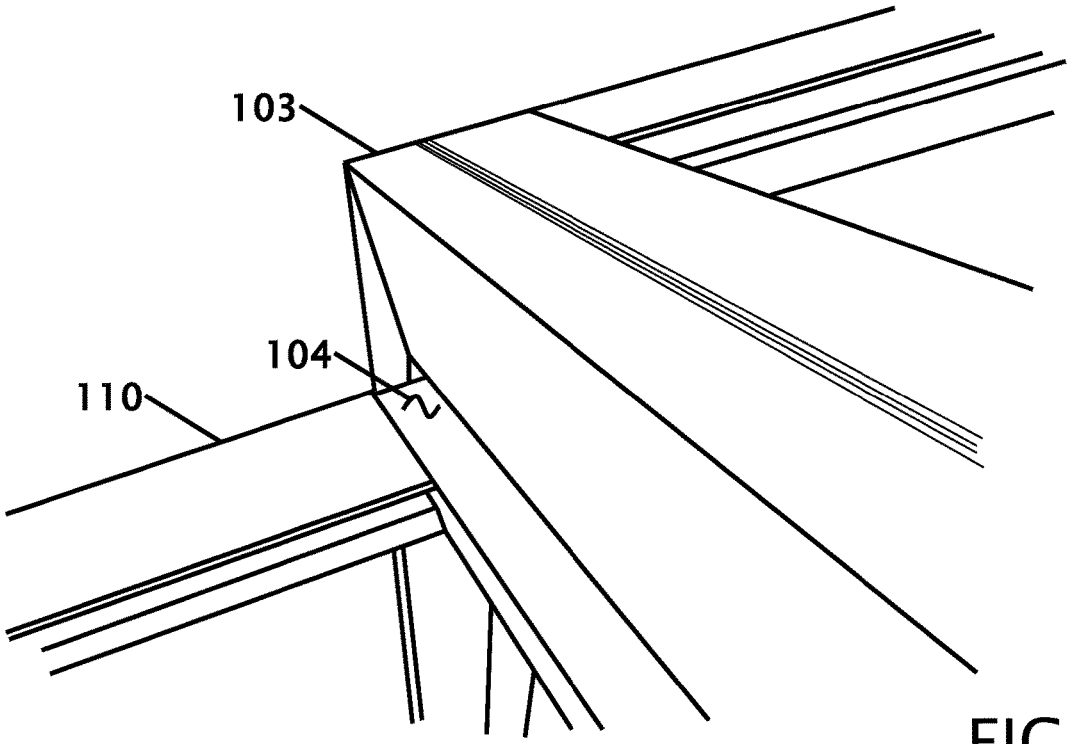
FIG. 10 shows a perspective view of an exterior view of the closed corner section.

FIG. 9 shows a perspective view of an intersection between two sections and FIG. 10 shows a perspective view of an exterior view of the closed corner section. FIG. 9 shows the corner connector quick connects 117 within the back rectangular "F" extrusion 104 and the front rectangular F extrusion 103 that are used to allow the enclosure elements to be quickly connected and secured. FIG. 9 also shows the "F" extrusion seal 125 that seals or flashes the sections together when the enclosure is completely expanded. The corner connector stiffener brackets 122 secure between the counter flash angle cap extrusion 110 and the back rectangular "F" extrusion 104 and the front rectangular F extrusion 103 to seal the top edges of the section(s).

Figure 11:
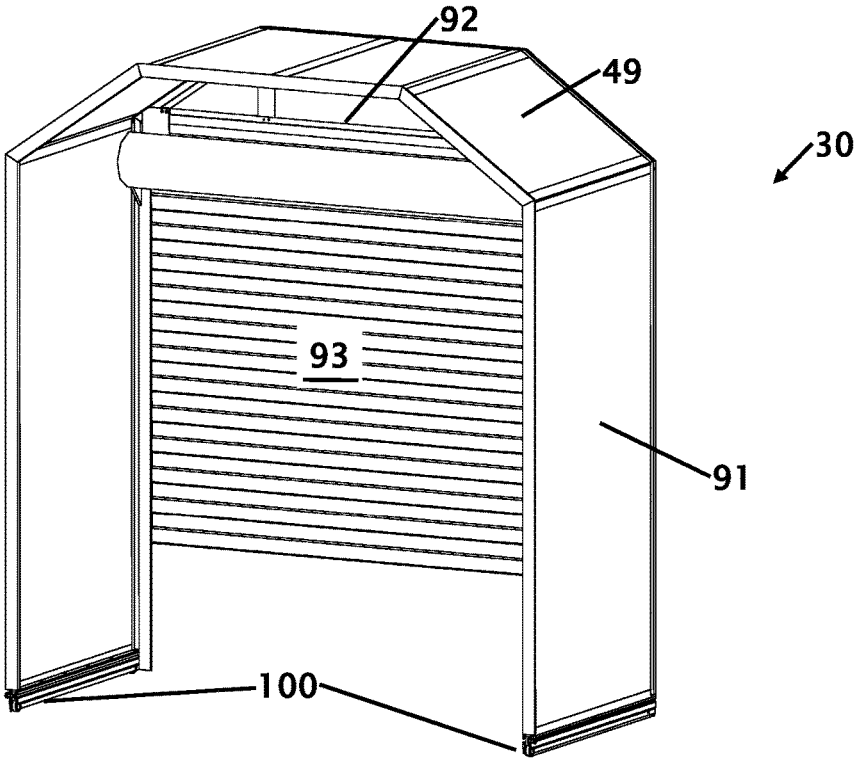
FIG. 11 shows a perspective view of the door section.

FIG. 11 shows a perspective view of the door section 30. The construction of the door section is similar to other sections with sides 91, and angle panel 49 and top side, but instead of the end being solid, there is a roll-up door 93. The door 93 is a sectional door and rolls into a spool 92. A torsion spring can be included within the spool 92 to assist in lifting the door 93. The bottom of the door section 30 is supported on both sides with a rail sub assembly 100.

Figure 12:
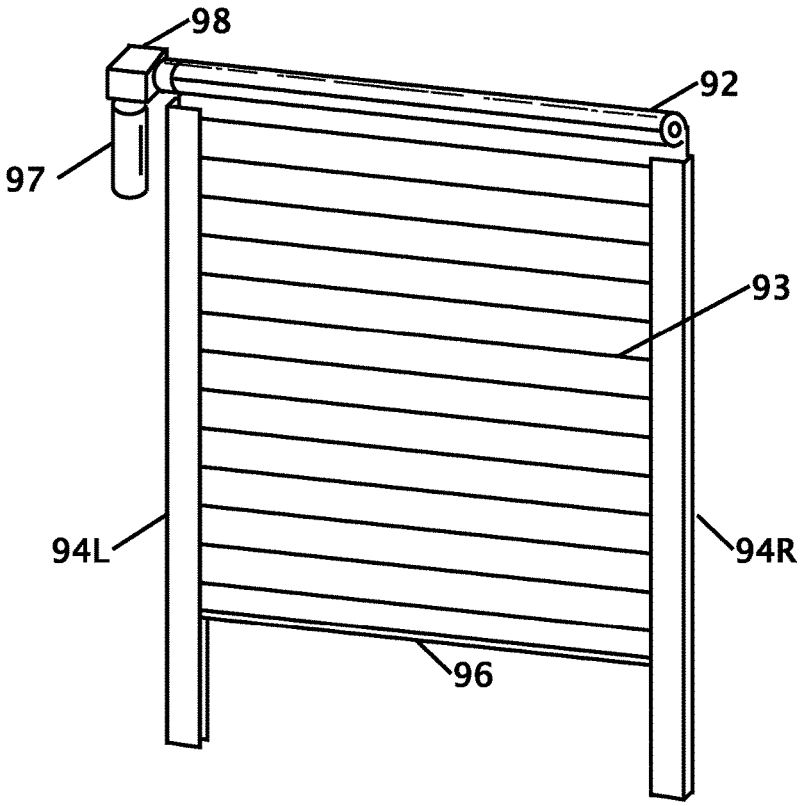
FIG. 12 shows a perspective view of a roll-up door.

FIG. 12 shows a perspective view of a roll-up door 93. This door 93 is a roll-up door with multiple plastic/vinyl, composite, polymers, metal-based sections 95 that are guided or tracked from the sides 94R, 94L. The bottom can have a seal 96 to prevent air flow under the door. The sectional elements are rolled on a spool 92. A motor 97 and transmission 98 can lift and lower the multiple sections of the door 93. The door can be controlled with a remote or with a wired button on the unit or at a distal location. The solar panels (not shown in this figure) can store power in batteries (not shown) to power the door in a self-contained environment.

Figure 13:
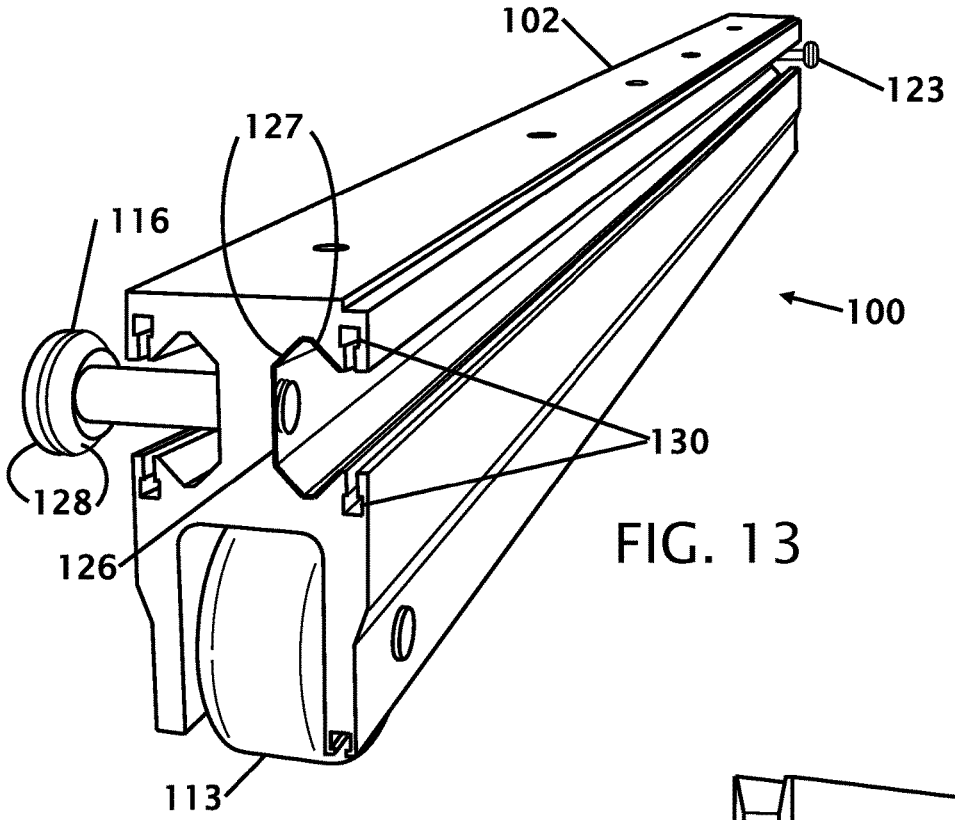
FIG. 13 shows a perspective view of a rail section.
Figure 14:
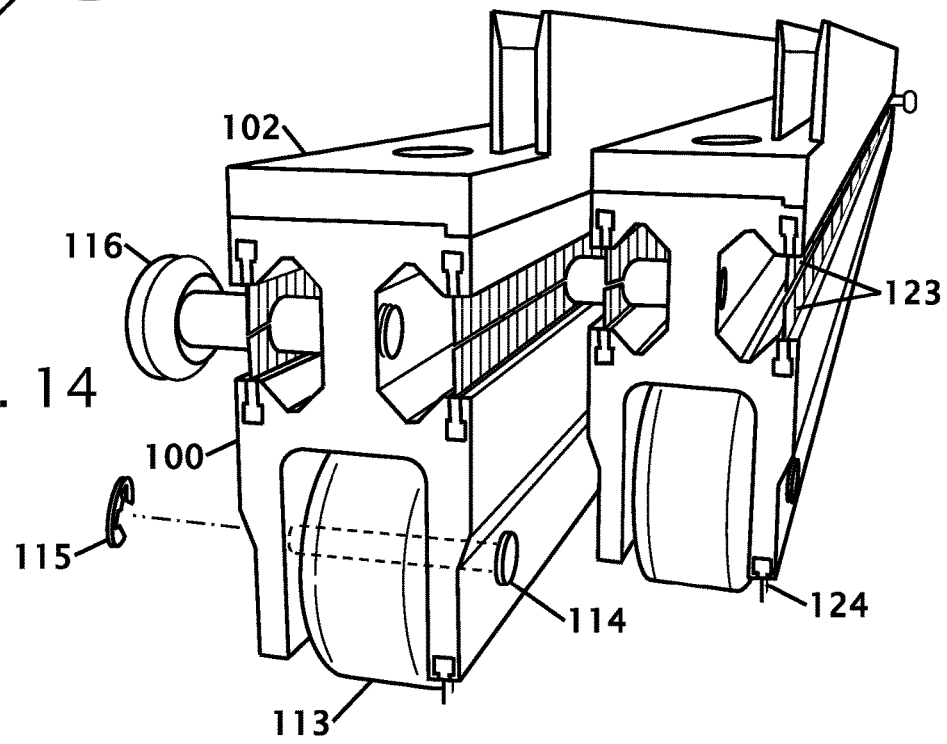
FIG. 14 shows a perspective view of two connected rail sections.

FIG. 13 shows a perspective view of a rail sub assembly 100 section and FIG. 14 shows a perspective view of two connected rail sub assembly 100 sections. A rail top extrusion 102 is secured to each rail sub assembly 100 and vertical panels are secured between the two vertical surfaces of the rail top extrusion 102. Each rail sub assembly 100 has at least one female pocket 126 that received the rail guide rod and wheel 116 as a male rail guide rod and wheel 116 roller that is captured and guided within the female pocket 126 (shown in bold outline). The rail sub assembly 100 has female pockets 126 on both sides to allow the same rail sub assembly 100 to be used on both the right and left sides of the enclosure sections.

The rail guide rod and wheel 116 are secured into the rail sub assembly 100 in alignment with the female pocket 126. The rail guide rod and wheel 116 are placed on both sides of the rail sub assembly 100 to align and track the enclosure sections in a parallel relationship. Adjacent rails have at least one female pocket 126 and a male rail guide rod and wheel 116 that track and guide at least two panel sections 30-35 (not shown in this figure). To align and track enclosure sections the wheel edges 128 are forced and guided in the female pocket edges 127.

The channeled linear rail built into the base of each panel has a two-point opposed guide rod with bearing wheel system (one at each end in opposite directions projecting out from each guide rail, the guide rails due to the opposed female pockets 126 with opposed male tracking rods with tracking wheels 116 creates a unique two points of contact from the front and back of each interlocking rail with very minimal friction that always self corrects the panel sections that are built upon them to remain in perfect alignment when either expanding or collapsing the system, this further allows the system to always maintain a perfect amount of equal space between each panel section. The advantages to this rail system with the opposed mail tracking guide rod wheel system are numerous, it creates a self-correcting, highly aligned, low friction telescoping system.

The rail sub assembly 100 is supported with wheel(s) 113 that roll on a flat surface as the sections expand. A wheel shaft 114 passes through each wheel 113 and is secured with a wheel moon clip 115. To prevent intrusion of contamination into the enclosure and the tracking system the rail sub assembly 100 has a plurality of brush pockets 130 that frame the female pockets 126 on two sides. Elongated rail guide rod and wheel seal 123 and rail guide rod and wheel seal 124 are used in the brush pockets 130. In some embodiments the brush is used on only one side to seal a surface, such as the ground, and in other cases opposing brushes are used to allow a wheel or shaft to pass in the opening between the two opposing sets of brushes.

Figure 15:
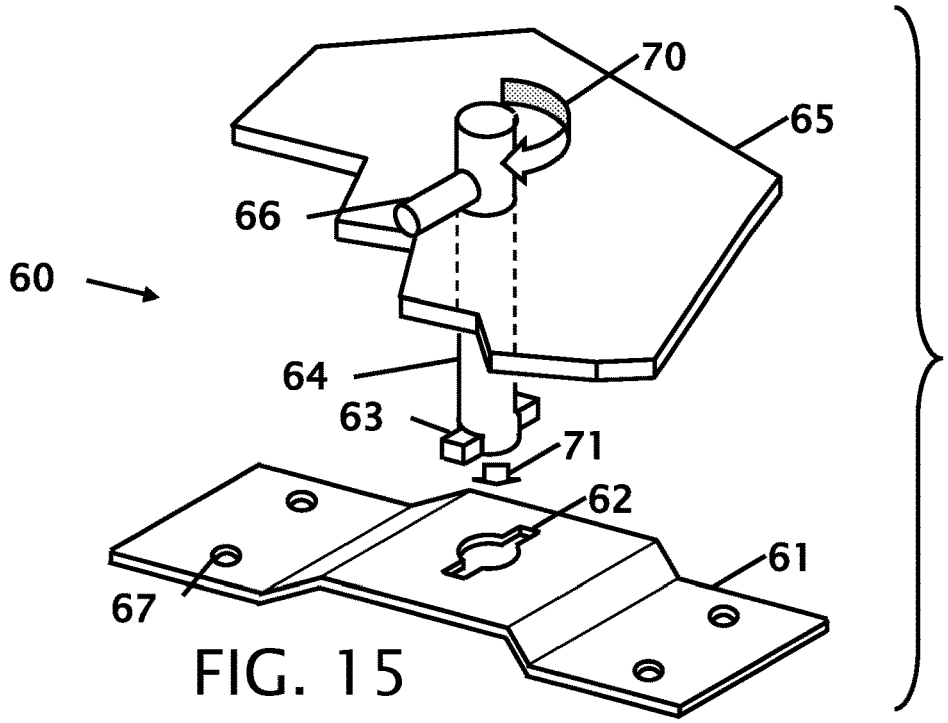
FIG. 15 shows a detail of a ground anchoring system.

FIG. 15 shows a detail of a ground anchoring system. The anchoring system uses a base plate 61. The base plate 61 is secured to the ground with bolts or other hardware that is secured through holes 67 and into a cement foundation, or with other fasteners that secures to base plate 61. The base plate 61 has an elevated central section with a key hole 62. When the cover is deployed the outer most section is securable into the base plate by depressing the shaft 64 down 71 into the keyhole 62 so the key 63 can pass into the keyhole 62. The handle 66 can then be rotated 70 to retain the plate 65 onto the base plate 61. The steps are reversed to release the plate 65 from the base plate 61. This system can be manually engaged or can automatically engaged to operate with the door or separately. It can also be incorporated at multiple locations along the retractable vehicle cover panels. While this particular securing mechanism is shown, other ground securing systems are contemplated, including but not limited to trolley and moving panel system hold down plunger locks and Augur system when not on concrete/asphalt/rigid surfaces.

Figure 16:
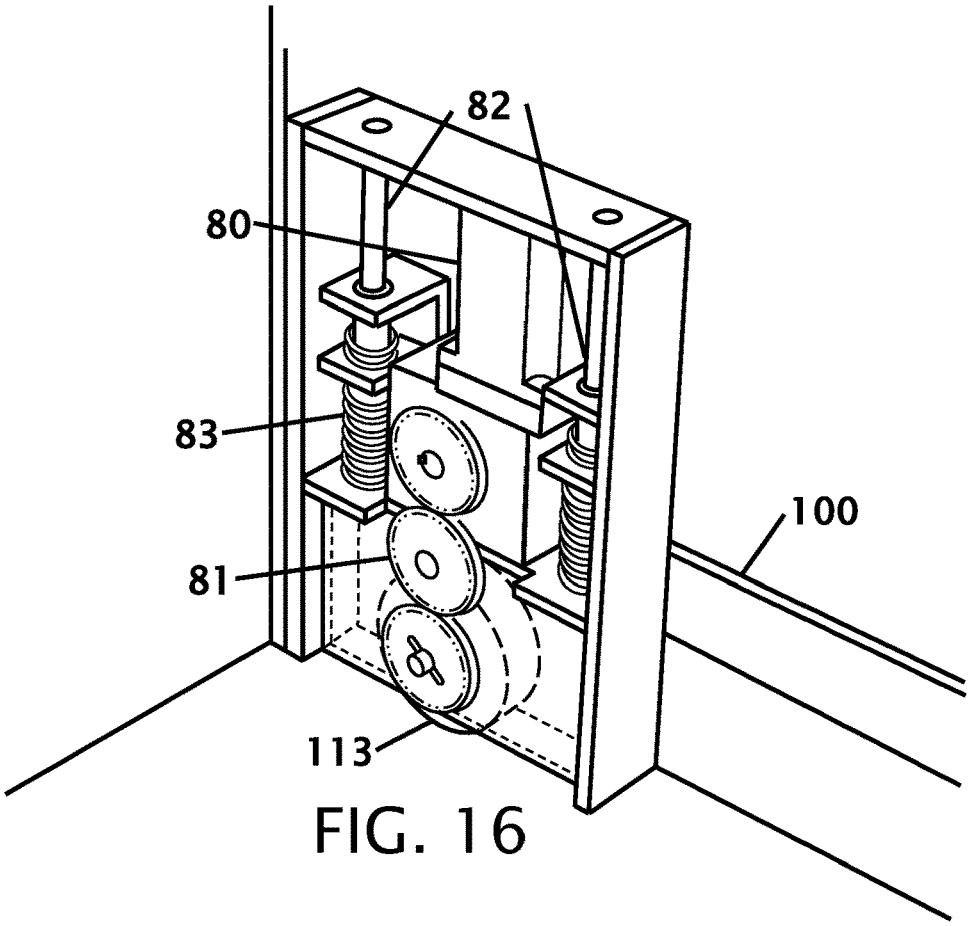
FIG. 16 shows a detail of a wheel drive system.

FIG. 16 shows a detail of a wheel 113 drive system on a rail sub assembly 100. A motor 80 drives though a series of transmission gears 81 to drive the wheel 113. This allows the enclosure to be extended or retracted with a remote control. A suspension system 82 accommodates height differences between the ground and the rail sub assembly 100. Springs 83 in the suspension system 82 constantly puts downward pressure from the referenced powered moving section to keep continuous traction regardless of the surface condition that the structure is moving over.

Thus, specific embodiments of a retractable vehicle cover have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A linear guide self-tracking modular telescoping structure comprising:

a retractable vehicle cover with at least one static panel section;

at least two moving panel sections that are configured to telescope within each other and within said at least one static panel section;

said at least one static section and said at least two moving panel sections progressively interconnect with at least two guide rods with wheels that are guided in extruded sections;

said at least two moving panel sections each telescope together and each at least two moving panel sections further includes a flashing on a top surface and both side surfaces;

said at least two moving panel sections each have at least one bottom brush pocket;

said flashing shields a first of said at least two moving panel sections with a second of said at least two moving panel sections when said moving panel sections are extended, and said at least two guide rods with wheels are guided in female pockets in said extruded sections.

2. The linear guide self-tracking modular telescoping structure according to claim 1, wherein said at least one static panel section is clad on four sides, thereby leaving a front and a bottom open.

3. The linear guide self-tracking modular telescoping structure according to claim 1, wherein said female pockets are framed with said at least one bottom brush pocket on two elongates sides.

4. The linear guide self-tracking modular telescoping structure according to claim 3, wherein said brush pockets include seals that allow said at least two guide rods to pass between said seals.

5. The linear guide self-tracking modular telescoping structure according to claim 4, wherein said seals seal said wheels within said female pocket.

6. The linear guide self-tracking modular telescoping structure according to claim 1, wherein said at least two guide rods extend from a first female pocket.

7. The linear guide self-tracking modular telescoping structure according to claim 6, wherein said at least two guide rods extend into a second female pocket.

8. The linear guide self-tracking modular telescoping structure according to claim 1, wherein said at least one static panel section and said at least two moving panel sections are insulated.

9. The linear guide self-tracking modular telescoping structure according to claim 1, wherein said at least two moving panel sections are covered with a covering material from a group of materials consisting of at least one of polyethylene, polycarbonate, polymer, cardboard, composites, ABS, PVC, fiberglass, fabric, glass and aluminum and metal.

10. The linear guide self-tracking modular telescoping structure according to claim 9, wherein said at least two moving panel sections have an opening that accepts said covering material.

11. The linear guide self-tracking modular telescoping structure according to claim 1, covers cars, trucks, boats, ATV's, motorcycles, bicycles, personal self-enclosure or recreational vehicles.

12. The linear guide self-tracking modular telescoping structure according to claim 1, further includes a seal between sides of said at least two panel sections.

13. The linear guide self-tracking modular telescoping structure according to claim 1, wherein said at least two moving panel sections each includes at least four wheels.

14. The linear guide self-tracking modular telescoping structure according to claim 13, wherein at least one of said at least four wheels is an electrically powered wheel.

15. The linear guide self-tracking modular telescoping structure according to claim 1, wherein said at least one bottom brush pocket includes a seal that seals said at least two moving panel sections with a ground surface.

16. The linear guide self-tracking modular telescoping structure according to claim 1, wherein said female pockets have pocket edges that force and guide wheel edges to align and track said at least two moving panel sections.

17. The linear guide self-tracking modular telescoping structure according to claim 1, wherein each lower side of said at least two moving panel sections have a rail sub assembly.

18. The linear guide self-tracking modular telescoping structure according to claim 1, wherein at least one of said at least two moving panel sections include a door.

19. The linear guide self-tracking modular telescoping structure according to claim 1, wherein said at least one static panel section is an enclosed end.

20. The linear guide self-tracking modular telescoping structure according to claim 1, further includes a seal between said at least two moving panel sections.

* * * * *